US011342642B2

(12) United States Patent
Psychogiou et al.

(10) Patent No.: US 11,342,642 B2
(45) Date of Patent: May 24, 2022

(54) HIGH-ORDER FULLY-RECONFIGURABLE BALANCED BANDPASS FILTERS

(71) Applicant: The Regents of the University of Colorado, Denver, CO (US)

(72) Inventors: Dimitra Psychogiou, Boulder, CO (US); Dakotah Simpson, Boulder, CO (US)

(73) Assignee: Regents of the University of Colorado a body corp, Denver, CO (US)

( * ) Notice: Subject to any disclaimer, the term of this patent is extended or adjusted under 35 U.S.C. 154(b) by 0 days.

(21) Appl. No.: 17/019,315

(22) Filed: Sep. 13, 2020

(65) Prior Publication Data

US 2021/0083352 A1 Mar. 18, 2021

Related U.S. Application Data

(60) Provisional application No. 62/899,968, filed on Sep. 13, 2019.

(51) Int. Cl.
*H01P 1/20* (2006.01)
*H01P 7/08* (2006.01)

(52) U.S. Cl.
CPC . *H01P 1/20* (2013.01); *H01P 7/08* (2013.01)

(58) Field of Classification Search
CPC .. H01P 1/20; H01P 1/203; H01P 1/201; H01P 7/08; H03H 11/04
See application file for complete search history.

(56) References Cited

PUBLICATIONS

Single-/Multi-Band Bandpass Filters and Duplexers With Fully Reconfigurable Transfer-Function Characteristics, by Dakotah J. Simpson, IEEE Transactions on Microwave Theory and Techniques, vol. 67, No. 5, May 2019.
Tunable Balanced Bandpass Filter With Wide Tuning Range of Center Frequency and Bandwidth Using Compact Coupled-Line Resonator, by He Zhu, IEEE Microwave and Wireless Components Letters, vol. 26, No. 1, Jan. 2016.
Fully-Reconfigurable Bandpass Filter With Static Couplings and Intrinsic-Switching Capabilities, by Roberto G'omez-Garc'ia, IEEE 2017.
High-Selectivity Tunable Balanced Bandpass Filter With Constant Absolute Bandwidth, by Wen-Jun Zhou, IEEE Transactions on Circuits and Systems—II: Express Briefs, vol. 64, No. 8, Aug. 2017.
(Continued)

*Primary Examiner* — Stephen E. Jones
(74) *Attorney, Agent, or Firm* — Macheledt Bales LLP; Jennifer L. Bales

(57) ABSTRACT

High-order balanced bandpass filters that are continuously tunable in terms of frequency and bandwidth (BW) and can be intrinsically switched-off. The filters include multiple resonant sections cascaded between a differential RF input and a differential RF output. The resonant sections comprise at least one multi-resonant cell and at least one transmission pole cell. The multi-resonant cell includes four frequency tunable resonators, and is configured to create a frequency tunable pole at the center frequency of the filter, and two frequency tunable transmission zeroes at resonating frequencies of the resonators of the multi-resonant cell. The transmission pole cells each include two resistively-terminated frequency-tunable resonators configured to resonate at the center frequency of the filter.

20 Claims, 15 Drawing Sheets

(56) References Cited

PUBLICATIONS

Balanced bandpass filter with tunable centre frequency based on substrate integrated waveguide technology, by Hao Zhang, Electronics Letters Jul. 12, 2018 vol. 54 No. 14 pp. 886-888.
Compact Tunable Balanced Bandpass Filter With Constant Bandwidth Based on Magnetically Coupled Resonators by Hong-Wei Deng, IEEE Microwave and Wireless Components Letters, vol. 29, No. 4, Apr. 2019.
Compact Tunable Balanced Bandpass Filter With Novel Multi-Mode Resonator, by Shi-Xuan Zhang, IEEE Microwave and Wireless Components Letters, vol. 27, No. 1, Jan. 2017.
Tunable differential-mode bandpass filters with wide tuning range and high common-mode suppression, by Jinrong Mao, IET Microw. Antennas Propag., 2014, vol. 8, Iss. 6, 2014.
The Proper Balance, by Wenjie Feng, IEEE Magazine 2015.
Coupling Matrix-Based Design of Fully Reconfigurable Differential/Balanced RF Filters, by Dakotah J. Simpson, IEEE Microwave and Wireless Components Letters, vol. 28, No. 10, Oct. 2018.

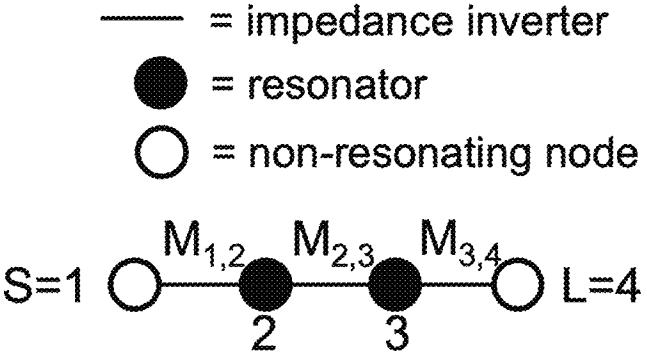
Figure 1A
(prior art)
100
$$M = \begin{pmatrix} 0 & M_{1,2} & 0 & 0 \\ M_{1,2} & M_{2,2} & M_{2,3} & 0 \\ 0 & M_{2,3} & M_{3,3} & M_{3,4} \\ 0 & 0 & M_{3,4} & 0 \end{pmatrix}$$
Figure 1B
(prior art)
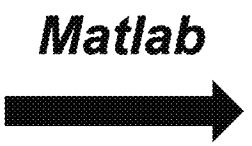
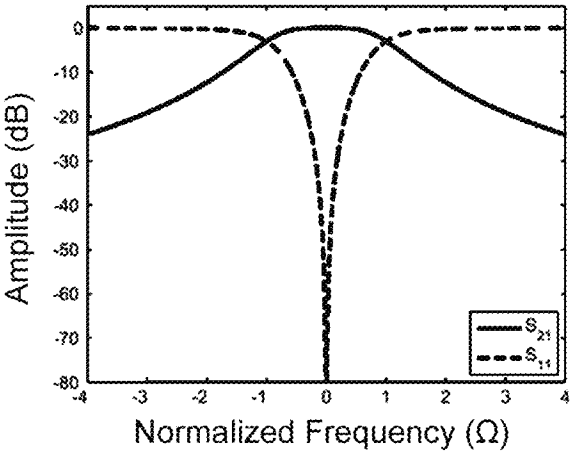
Figure 1C
(prior art)

$$M = \begin{pmatrix} 0 & M_{1,3} & 0 & 0 & 0 & 0 & 0 \\ M_{1,3} & \boldsymbol{M_{3,3}} & M_{3,4} & 0 & 0 & 0 & 0 \\ 0 & M_{3,4} & 0 & M_{4,5} & M_{4,6} & M_{4,7} & 0 \\ 0 & 0 & M_{4,5} & \boldsymbol{M_{5,5}} & 0 & 0 & 0 \\ 0 & 0 & M_{4,6} & 0 & \boldsymbol{M_{6,6}} & 0 & 0 \\ 0 & 0 & M_{4,7} & 0 & 0 & \boldsymbol{M_{7,7}} & M_{7,9} \\ 0 & 0 & 0 & 0 & 0 & M_{7,9} & 0 \end{pmatrix}$$

*Reconfigurability:*

- Frequency: Synchronously tune $M_{3,3}$ & $M_{7,7}$, and tune $M_{5,5}$ & $M_{6,6}$ equally
- Bandwidth: Move TZs through $M_{5,5}$ & $M_{6,6}$
- Intrinsic switching: $M_{3,3}=M_{7,7}=M_{5,5}=M_{6,6}$

Figure 3

$$M = \begin{pmatrix} 0 & M_{1,2} & M_{1,3} & 0 & 0 & 0 & 0 & 0 & 0 \\ M_{1,2} & M_{2,2} & 0 & 0 & 0 & 0 & 0 & 0 & 0 \\ M_{1,3} & 0 & M_{3,3} - j\sigma_3 & M_{3,4} & 0 & 0 & 0 & 0 & 0 \\ 0 & 0 & M_{3,4} & 0 & M_{4,5} & M_{4,6} & M_{4,7} & 0 & 0 \\ 0 & 0 & 0 & M_{4,5} & M_{5,5} & 0 & 0 & 0 & 0 \\ 0 & 0 & 0 & M_{4,6} & 0 & M_{6,6} & 0 & 0 & 0 \\ 0 & 0 & 0 & M_{4,7} & 0 & 0 & M_{7,7} - j\sigma_7 & 0 & M_{7,9} \\ 0 & 0 & 0 & 0 & 0 & 0 & 0 & M_{8,8} & M_{8,9} \\ 0 & 0 & 0 & 0 & 0 & 0 & M_{7,9} & M_{8,9} & 0 \end{pmatrix}$$

Loss modeling:

$$\sigma_i = \frac{1}{FBW * Q_i}$$

Figure 4

*Short-circuit* along line of symmetry
➔ Resistors shorted
➔ Added line not present

*Open-circuit* along line of symmetry
➔ Resistors present, add loss
➔ Added line present, adds TZ

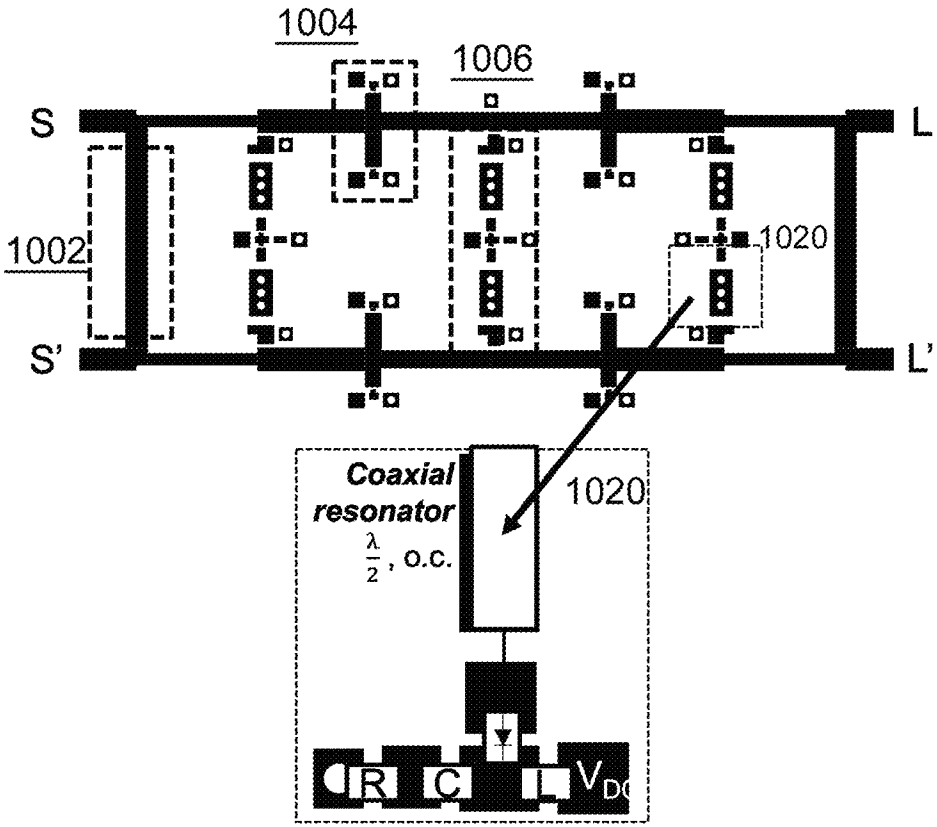
Figure 10B
Figure 10C
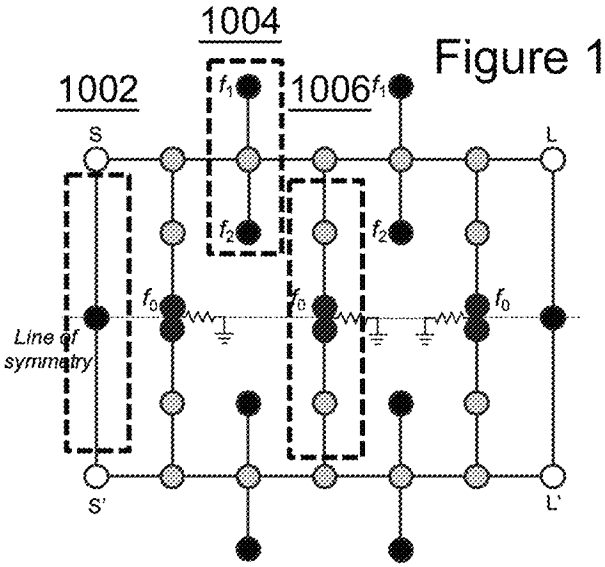
Figure 10A
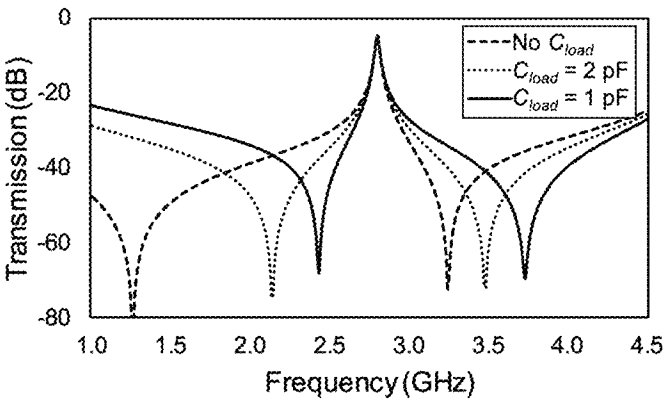
Figure 10D

HIGH-ORDER FULLY-RECONFIGURABLE BALANCED BANDPASS FILTERS

BACKGROUND OF THE INVENTION

Field of the Invention

The present invention relates to high-order fully-reconfigurable balanced bandpass filters that are continuously tunable in terms of center frequency and bandwidth (BW) and can be intrinsically switched-off.

Discussion of Related Art

Balanced RF circuits are becoming increasingly important in modern communication systems due to their higher immunity—compared to their single-ended counterparts—to electromagnetic interference, crosstalk, and other sources of noise. High frequency differential/balanced bandpass filters (BPFs) are fundamental elements of differential RF transceivers due to their primary role in selecting the desired band of interest while suppressing the noise and electromagnetic interference in the RF front-end. Recent research efforts are focusing on incorporating tunability in these filters due to the need for RF front-ends with multi-standard and multi-band operability.

The RF design of differential BPFs is typically performed by incorporating two single-ended BPFs within a balanced network that is designed for as high as possible common-mode suppression. A wide variety of implementations exist with the majority of them focusing on planar integration and on low-order transfer functions. Most achieve low common-mode suppression (on the order of 20 dB) and narrow frequency and narrow bandwidth tuning (e.g. 2.2:1) or no bandwidth tuning. Others require mechanical tuning elements. Most are limited by either reduced common-mode suppression or poor differential-mode selectivity.

SUMMARY OF THE INVENTION

High-order fully-reconfigurable balanced bandpass filters according to the present invention are tunable and can be intrinsically switched off. Embodiments exhibit quasi-elliptic-type high-order power transmission response in their differential-mode of operation and a highly suppressed common-mode of operation. The differential mode is shaped by multiple transmission zeros (TZs) and poles and the overall response is tunable in terms of center frequency and BW and can be intrinsically switched-off.

Coupling matrix design was used to design such differential/balanced filters. Embodiments exhibit i) a highly-suppressed common mode that is obtained by multiple transmission zeros (TZs) and resistively-loaded poles and ii) a differential mode that exhibits a quasi-elliptic-type transfer function that can be tuned in frequency and in bandwidth (BW) and can be intrinsically switched-off. The filter's reconfiguration properties are attained by only tuning/reconfiguring/altering the resonant frequencies of its constituent resonators. Thus, it exhibits less in-band insertion loss (IL) than tunable differential architectures in which tuning of couplings is required.

Various embodiments have differing amounts transmission zeroes (TZs) and poles. For example, some embodiments have two transmission zeroes and three poles. Other embodiments have four transmission zeros and five poles. The overall response is tunable in terms of center frequency and BW and can be intrinsically switched-off.

For practical validation purposes, a microstrip differential/balanced filter prototype was manufactured and measured in the 1.4-1.9 GHz range with the following characteristics. Differential-mode: center frequency tuning between 1.36-1.9 GHz (1.4:1), BW tuning between 43-270 MHz (6.3:1) and an intrinsically switched-off mode with isolation (IS) >22 dB. Common-mode: 70% 40-dB suppression BW and IS >60 dB at the center frequency for all tunable states.

A second high-order balanced/differential filter prototype with improved RF performance in terms of selectivity and out-of-band suppression was also manufactured and measured and demonstrated frequency tuning between 2.22-2.94 GHz (1.3:1), BW tuning between 104-268 MHz (2.6:1), and an intrinsically switched-off mode with isolation >50 dB. For all these states, the common-mode suppression was >35 dB. This prototype used mixed coaxial and microstrip resonators. In this example capacitively-loaded ceramic coaxial and microstrip resonators were used for size compactness and low insertion loss (IL). Furthermore, the quarter-wave series-type resonances of the coaxial resonator are used for the suppression of the spurious modes in the differential mode.

A balanced/differential bandpass filter includes multiple resonant sections cascaded between a differential RF input and a differential RF output. The sections include at least one multi-resonant cell (MRC), having four frequency tunable MRC resonators, a frequency tunable pole at a center frequency of the filter ($f_0$), and two frequency tunable transmission zeroes (TZs) at resonating frequencies of MRC resonators.

It also includes at least one transmission pole cell (TPC), having two resistively-terminated frequency-tunable TPC resonators configured to resonate at $f_0$. The balanced/differential filter has a line of symmetry and each resonant section is symmetrical along the line of symmetry. The resonant sections are cascaded through impedance inverters.

The filter is highly tunable. Center frequency $f_0$ is tuned by synchronously tuning the resonance of the MRC resonators and the TPC resonators. The bandwidth is tuned by tuning the resonance of the MRC resonators. The filter can be intrinsically turned off by positioning the TZs of the MRC at the same frequency as the poles. It is not necessary to tune couplings—tuning resonators suffices.

As a feature, the filter may include a common-mode suppression line and a TZ resonator disposed between ends of the differential RF input and a common-mode suppression line and a TZ resonator disposed between ends of the differential RF input.

In general filters have K resonant sections, M TPCs and N MRCs, configured to result in between 1 and N TZs in the differential mode of operation and between 2 and 2N+2 TZs in the common mode of operation.

Some embodiments use hybrid integration by including both capacitively loaded coaxial resonators and microstrip resonators. For example, the TCP resonators comprise capacitively loaded coaxial resonators and the MRC resonators comprise quarter wavelength long transmission line resonators.

BRIEF DESCRIPTION OF THE DRAWINGS

FIG. 1A (prior art) is a coupling matrix diagram of a single-ended existing filter.

FIG. 1B (prior art) is the coupling matrix associated with the design of FIG. 1A.

FIG. 1C (prior art) is the synthesized response of the design of FIG. 1A.

FIG. 3 shows the coupling matrix associated with the differential-mode portion of the design in FIG. 2B.

FIG. 4 shows the coupling matrix associated with the common-mode portion of the design of FIG. 2C.

FIG. 10A is an annotated diagram of the coupling matrix diagram in FIG. 8A. FIG. 10B is a diagram of a physical layout of circuitry implementing the design of FIG. 8A. FIG. 10C is a diagram of a coaxial resonator used in the circuitry of FIG. 10B to enhance its out of-band selectivity and improve its in-band insertion loss. FIG. 10D is a plot showing the response of the circuitry of FIG. 10B.

DETAILED DESCRIPTION OF THE INVENTION

A new class of fully-reconfigurable balanced bandpass filters (BPFs) with a quasi-elliptic-type differential-mode and high common-mode suppression are described below. The filters allow for multiple levels of transfer function reconfigurability to be obtained in the differential-mode whilst obtaining wideband (>70%) high common-mode suppression (>40 dB) for all reconfigurable states. This includes: center frequency tuning, BW tuning, and intrinsic RF-switching-off.

The reconfigurable characteristics are obtained by tuning the filter's resonators—as opposed to conventional filter tuning methods in which both resonators and couplings are tuned—which results in reduced loss and complexity and better linearity.

FIGS. 1A-1C (prior art) illustrate the coupling matrix diagram (CMD) method of creating and analyzing an existing single-ended filter. FIGS. 2A-7D illustrate the configuration and RF performance of a first balanced filter. FIGS. 8A-12D illustrate the configuration of a second balanced filter with improved RF performance in terms of out-of-band selectivity, common-mode suppression and lower in-band insertion loss. FIGS. 13A-J illustrate expansion of the proposed concept to higher order balanced filters through generalized coupling matrix-based diagrams and conceptual power transmission and reflection responses.

FIG. 1A (prior art) is a coupling matrix diagram of an existing, single-ended (i.e., non-differential filter) filter 100 provided to illustrate coupling matrix diagram (CMD) analysis. It includes source 1, two resonators 2 and 3, and load 4. FIG. 1B (prior art) is the coupling matrix associated with the design of FIG. 1A illustrating how each element is coupled to every other element. FIG. 1C (prior art) is the synthesized response of the design of FIG. 1A, generated in Matlab. The solid line represents $s_{21}$ (through signal) and the dotted line illustrates $s_{11}$ (reflection).

Figure 2B:
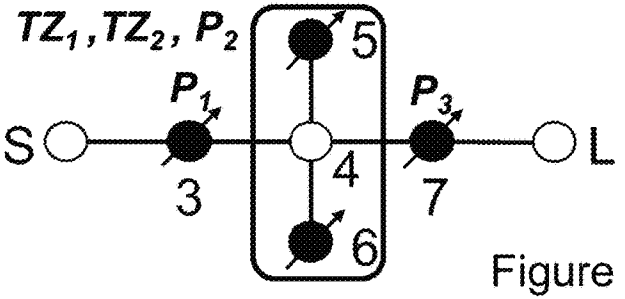
FIG. 2B is an equivalent diagram illustrating the differential-mode portion of the design.
Figure 2C:
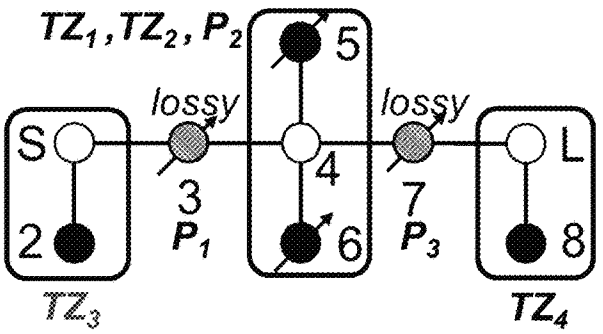
FIG. 2C is an equivalent diagram illustrating the common-mode portion of the design.
Figure 2A:
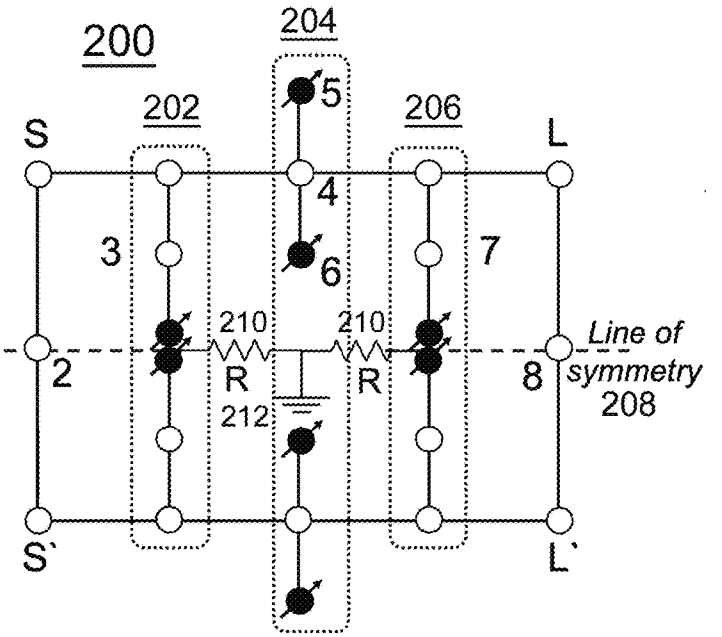
FIG. 2A is the main coupling matrix diagram of a first balanced filter according to the present invention.

FIG. 2A is a coupling matrix diagram (CMD) of the entire architecture of a balanced filter 200 according to the present invention. This is the first time a balanced filter has been modelled with CMD. It includes three resonant sections 202, 204, 206. Resonant sections 202 and 206 are transmission pole cells (TPC) and resonant section 204 is a multi-resonant cell (MRC).

Nodes are labelled 2-8. White circles indicate non-resonant nodes, and black circles indicate resonant nodes. The two non-resonant nodes and one resonant node in box 3 are combined as node 3 in the following diagrams, and node 7 is a similar combination. The differential RF input (source) is at S, S' and the differential RF output (load) is at L, L'. The dotted line indicates the line of symmetry 208. Resistors 210 are on the conceptual line of symmetry (not a separate physical structure) 208, and ground 212 is indicated.

FIG. 2B is a diagram illustrating the CMD of the differential-mode excitation portion of the design. Under the differential-mode of operation, a virtual ground is present along the horizontal line of symmetry and as such, the filter response can be represented by the CMD equivalent shown in FIG. 2B. In particular, the virtual ground cancels out the presence of the resistors and virtually shorts (at the location of nodes 2 and 8) the impedance inverters at the balanced input/output ports which in turn act as all-pass networks and can be neglected in the differential CMD equivalent. The differential BPF response (see conceptual response in FIG. 2D) is created as follows. Nodes 4-6 interact with each other and result in two frequency-tunable TZs, $TZ_1$ & $TZ_2$, and one pole, $P_2$. $TZ_1$ and $TZ_2$ are located at the resonant frequencies of nodes 5 and 6 and the pole is located at the frequency at which the two input admittances looking towards nodes 5 and 6 from node 4 cancel out. Furthermore, nodes 3 and 7 contribute to the differential passband with one pole each ($P_1$, $P_3$) at their respective resonant frequencies.

Figure 2D:
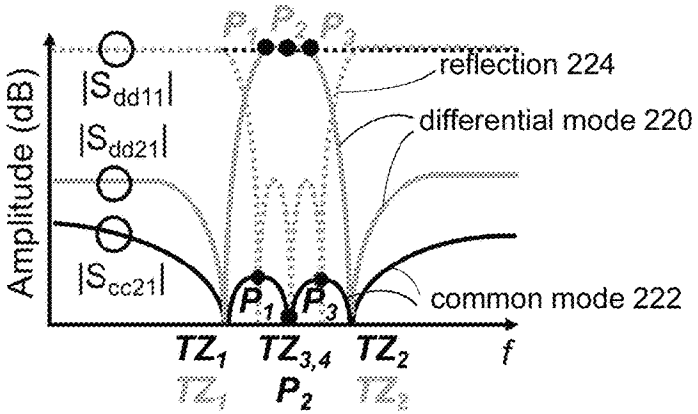
FIG. 2D shows conceptual plots of differential (DD) and common (CC) mode responses of the design of FIG. 2A.

FIG. 2C is a diagram illustrating the CMD of the common-mode excitation portion of the design and FIG. 2D shows its conceptual response. Under the common-mode of operation, it is assumed that there is a virtual open along the horizontal line of symmetry 208 of the balanced BPF 200 and thus the common-mode response can be represented by the CMD in FIG. 2C. The virtual open enables the presence of the resistors 210 in the common-mode CMD that resistively load the resonating nodes 3 and 7 and weaken the presence of poles $P_1$, $P_3$, which would otherwise allow RF signal transmission. In addition, nodes 4-6 interact with each other and result in the same TZs: $TZ_1$ & $TZ_2$, and pole: $P_2$ as in the differential-mode response. Furthermore, the presence of the virtual open results in two open-ended impedance inverters at the balanced input/output ports which result in two TZs ($TZ_3$ & $TZ_4$) that are located at the center frequency of the filter and are responsible for canceling out $P_2$ (i.e., it does not contribute in the overall transfer function of the common mode). As such, the open-ended impedance inverters in the common mode CMD equivalent are represented as resonating nodes (2 and 8) that are connected to the source/load through impedance inverters. Therefore, the common-mode is suppressed through added TZs and resistive-loading.

FIG. 2D shows plots of conceptual differential and common mode responses of the design of FIG. 2A, shown and described in more detail below (see FIGS. 5A-C). The solid-gray-line plot 220 is the differential mode, the black plot 222 is the suppressed common mode, and the gray-dotted plot 224 is differential mode reflection. The indicated traces and labels correspond to the following S-parameters. $|S_{dd11}|$ is the input reflection coefficient of the differential mode. $|S_{dd21}|$ the power transmission coefficient of the differential mode. $|S_{cc11}|$ (not shown) is the input reflection coefficient of the common mode. $|S_{cc21}|$ is the power transmission coefficient of the common mode.

FIG. 3 shows the coupling matrix associated with the differential-mode portion of the design of FIG. 2A.

FIG. 4 shows the coupling matrix associated with the common-mode portion of the design of FIG. 2A.

Figure 5A:
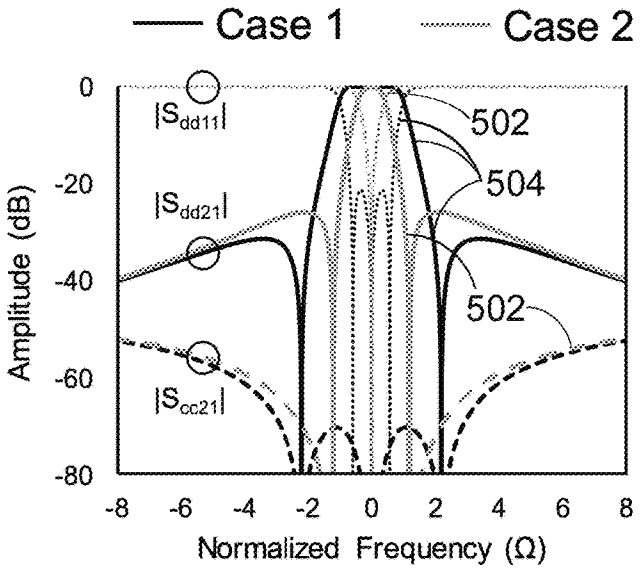
FIG. 5A shows plots illustrating how the bandwidth of the design of FIG. 2A is tuned.

FIG. 5A shows plots illustrating how the bandwidth of the design of FIG. 2A is tuned. Gray traces 502 indicate the narrower BW (case 1) and black traces 504 are the wider BW (case 2). More detail of the cases is given below. FIG. 5B shows plots illustrating how the center frequency of the design of FIG. 2A is tuned. Gray traces 506 indicate the higher center frequency (case 4) and black traces 508 are the lower center frequency (case 3). FIG. 5C shows plots illustrating how intrinsic switching is accomplished. Gray traces 510 (case 6) indicate a first set of parameters and black traces 512 (case 5) are a second set. The reconfiguration capabilities and operating principles of the balanced BPF are illustrated in FIGS. 5A-C through various sets of analytically-synthesized responses using the CMDs in FIGS. 2B and 2C and the equivalent matrices of the differential mode in FIG. 3 and the common mode in FIG. 4.

FIG. 5A illustrates BW tuning, proven by adjusting the separation of the two tunable TZs. ($M_{5,5}$ varied from −2.2 to −1.2, $M_{6,6}$ varied from 2.2 to 1.2, differential-mode: $M_{3,3}=M_{7,7}=0$, common-mode: $M_{3,3}=M_{7,7}=-j2.5$,). Case 1 (black lines 504) has $M_{5,5}=-2.2$, $M_{6,6}=2.2$. Case 2 (gray lines 502) has $M_{5,5}=-1.2$, $M_{6,6}=1.2$. Both have $M_{1,3}=M_{7,9}=0.9$, $M_{3,4}=M_{4,7}=1$, $M_{4,5}=M_{4,6}=2.1$, $M_{2,2}=M_{8,8}=0$. This results in a wider bandwidth for Case 1, 504.

Figure 5B:
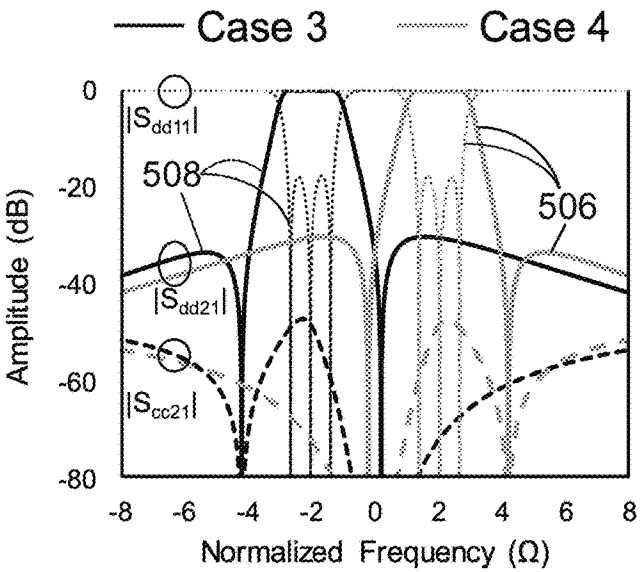
FIG. 5B shows plots illustrating how the center frequency of the design of FIG. 2A is tuned.

FIG. 5B illustrates center frequency tuning, achieved by synchronously tuning the resonant frequencies of all resonators (nodes 3, 5, 6, 7). The finite isolation that is observed in the common mode when tuning the center frequency away from the design frequency (at $\Omega=0$) is attributed to the fact that $TZ_{3,4}$ cannot be tuned. ($M_{5,5}=\mp 0.2$, $M_{6,6}=\pm 4.2$, differential-mode: $M_{3,3}=M_{7,7}=\pm 1.8$, common-mode: $M_{3,3}=M_{7,7}=\pm 1.8-j2.5$,). Case 3 (black lines 508) $M_{3,3}=M_{7,7}=1.83$, $M_{5,5}=-0.2$, $M_{6,6}=4.2$. Case 4 (gray lines 506) $M_{3,3}=M_{7,7}=1.83$, $M_{5,5}=0.2$, $M_{6,6}=-4.2$. Both have $M_{1,3}=M_{7,9}=0.9$, $M_{3,4}=M_{4,7}=1$, $M_{4,5}=M_{4,6}=2.1$, $M_{2,2}=M_{8,8}=0$. Case 4 (gray lines 506) has a higher center frequency than Case 3 (black lines 508).

Figure 5C:
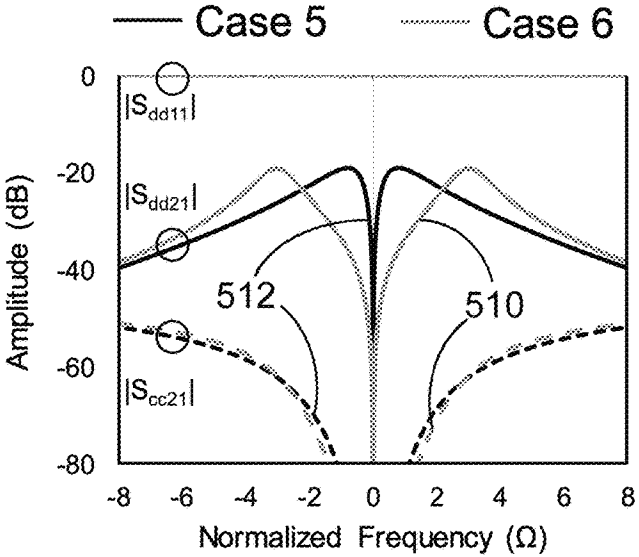
FIG. 5C shows plots illustrating how intrinsic switching is accomplished.

FIG. 5C illustrates intrinsic-switching-off of the filter. By positioning the two TZs at the same frequency as the poles, the passband is intrinsically-switched-off. (differential-mode: $M_{3,3}=-M_{7,7}$ varied from 0 to 3, common-mode: $M_{3,3}$ varied from $-j2.5$ to $3-j2.5$, $M_{7,7}$ varied from $-j2.5$ to $-3-j2.5$). Case 5 (black lines 512) has $M_{3,3}=M_{7,7}=0$. Case 6 (gray lines 510) has $M_{3,3}=-3$, $M_{7,7}=3$, $M_{5,5}=M_{6,6}=0$. Both have $M_{1,3}=M_{7,9}=0.9$, $M_{3,4}=M_{4,7}=1$, $M_{4,5}=M_{4,6}=2.1$, $M_{2,2}=M_{5,5}=M_{6,6}=M_{8,8}=0$.

Figure 6A:
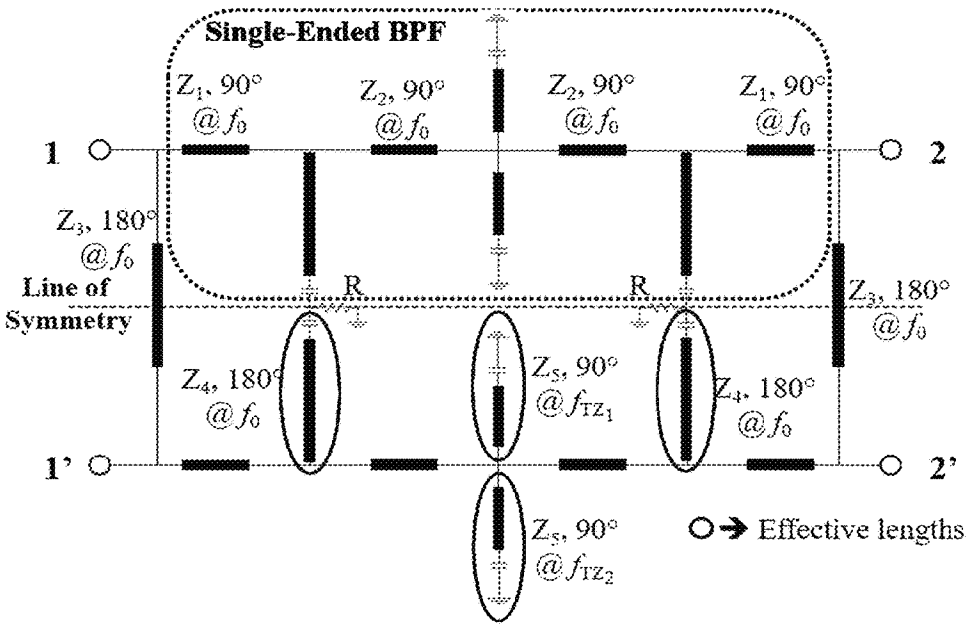
FIG. 6A is a circuit diagram illustrating a microstrip embodiment of the design of FIG. 2A.
Figure 6C:
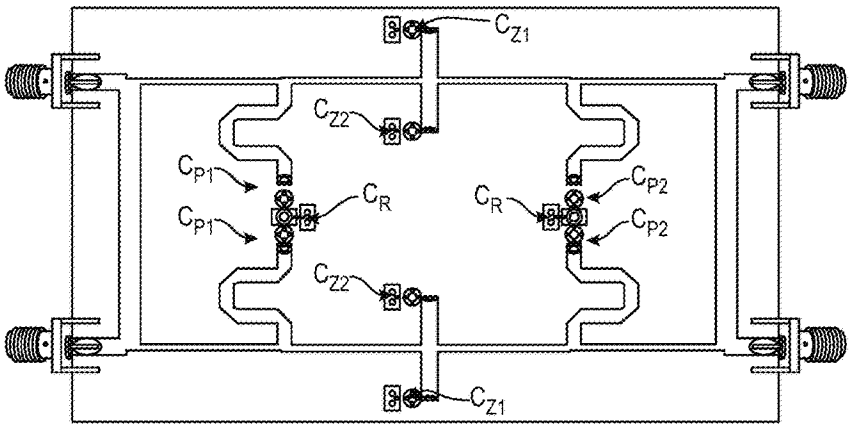
FIG. 6C is an image of the manufactured filter.
Figure 6B:
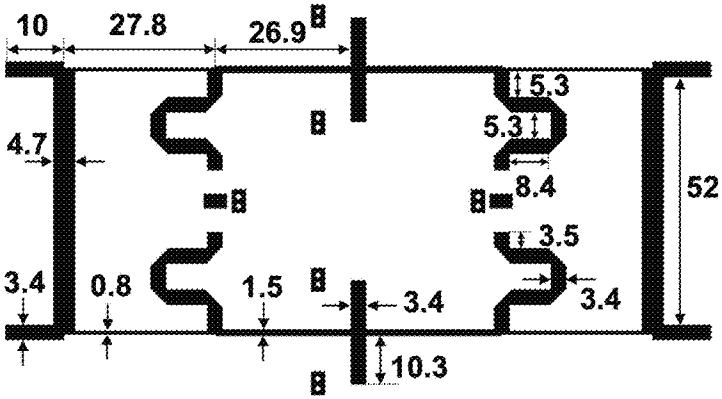
FIG. 6B shows a layout of the embodiment of FIG. 6A.

FIG. 6A is a circuit diagram illustrating a microstrip embodiment of the CMD of the differential/balanced filter in FIG. 2A. FIG. 6B shows the layout of the embodiment of FIG. 6A. Dimensions are in mm. FIG. 6C is a photograph of the manufactured filter.

To validate the practical viability of the fully-reconfigurable RF balanced/differential filter concept, a microstrip prototype was designed at 1.7 GHz with a fractional bandwidth of 10%. The layout and photograph of the filter prototype are shown in FIGS. 6B and 6C respectively. It was designed on a Rogers RO4003C substrate with relative dielectric permittivity $\varepsilon_r=3.38$, dielectric thickness H=1.52 mm, 1 oz. copper cladding, and dielectric loss tangent tan $\delta_D=0.0027$. The resonators and impedance inverters were realized using standard filter design techniques. Each tunable resonator represented by nodes 3 and 7 was materialized with an equivalent capacitively-loaded half-wavelength-long transmission line (TL). In addition, a resistor R (22Ω) was added at its end to provide the required resistive loading at the common-mode of operation. The tunable resonators that correspond to nodes 5 and 6 and their adjacent impedance inverters were realized as series-type capacitively-loaded quarter-wavelength TL resonators. The rest of the static impedance inverters were implemented as quarter-wavelength TLs at 1.7 GHz. Frequency tunability is achieved with mechanically-adjustable capacitors (C=1-5 pF). Other methods of tuning including varactor diodes or MEMS can also be used.

Figure 7A:
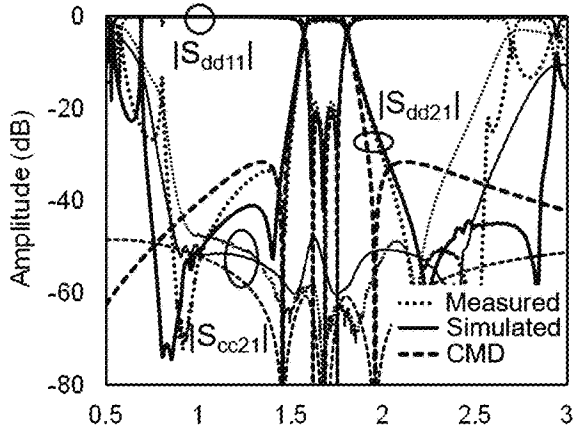
FIGS. 7A-D are plots showing the performance of the circuitry of FIGS. 2A-6C.
Figure 7B:
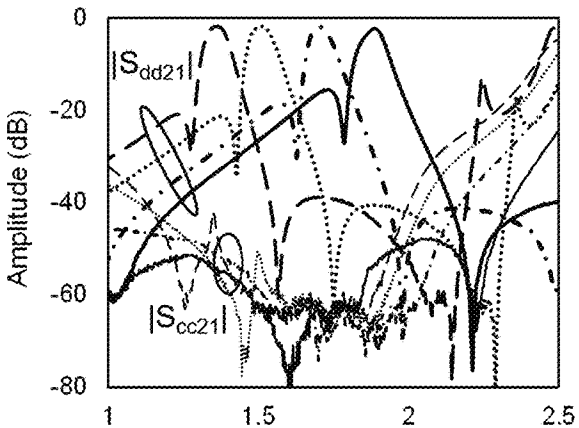
Figure 7C:
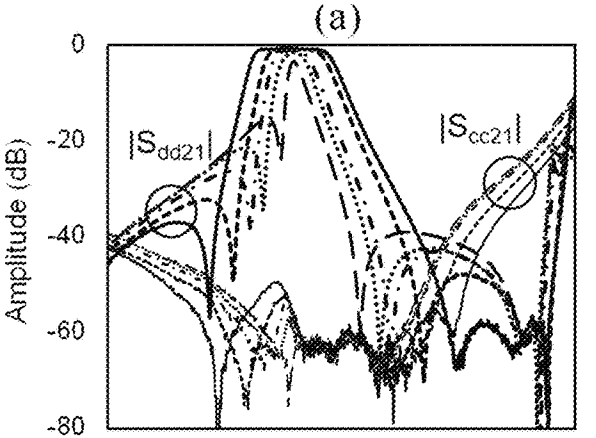
Figure 7D:
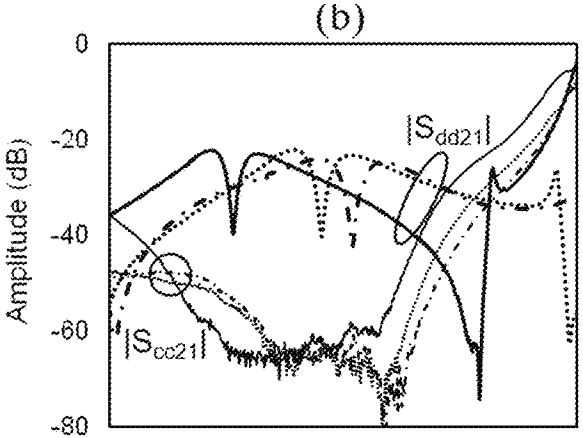

FIG. 7A is a plot comparing CMD, simulated, and measured response of the circuitry of FIG. 2A. FIG. 7B is a plot showing measured center frequency tuning of the circuitry of FIG. 2A. FIG. 7C is a plot showing measured BW tuning of the circuitry of FIG. 2A. FIG. 7D is a plot showing measured switching off of the circuitry of FIG. 2A. These plots show high correspondence between the CMD modelling and actual performance.

The simulated and measured power transmission and reflection responses of the microstrip prototype are shown in FIGS. 7A-7D. In particular, FIG. 7A compares RF-measured, EM-simulated, and CMD-synthesized states, which as can be seen are in fair agreement and demonstrate that the common-mode is suppressed by over 80 dB at the center frequency and by 50 dB from 1.1-2.2 GHz (one octave). FIG. 7B shows the ability of the proposed balanced BPF concept to achieve center frequency tuning—tuning range: 1.36-1.9 GHz (1.4:1) and IL: 1.79-2.33 dB—for a nearly constant BW of 80 MHz. FIG. 7C depicts BW control between 43-270 MHz (6.3:1) at a frequency of 1.6 GHz.

Within this range, the IL varies from 0.83-3.5 dB that corresponds to an effective quality factor ($Q_{eff}$) between 200-280. It should be noted that a tunable BW can be obtained over the entire 1.4-1.9 GHz range. Lastly, FIG. 7D shows multiple intrinsically-switched-off states that exhibit differential-mode attenuation of greater than 22 dB over the entire frequency range between 1-2.5 GHz and around 40 dB at frequencies where the filter's resonators are simultaneously tuned. The common-mode suppression is >40 dB over a 70% BW and >60 dB at the center frequency for all tunable states.

Figure 8B:
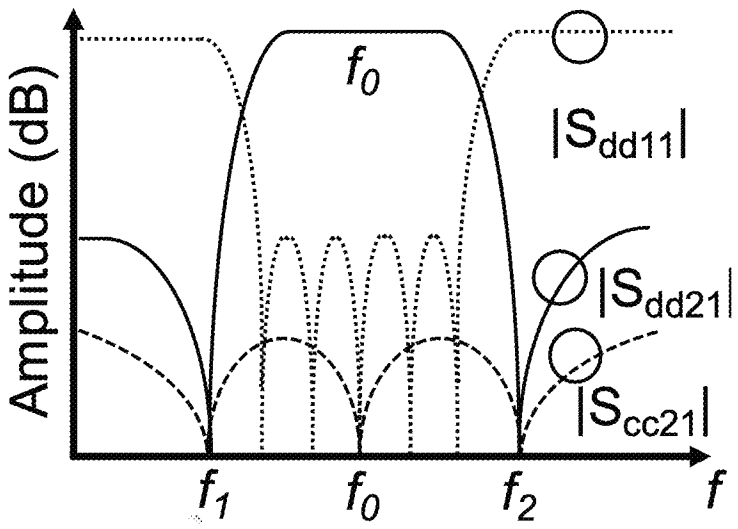
FIG. 8B is a diagram illustrating the differential-mode and common-mode responses of the design of FIG. 8A.
Figure 8A:
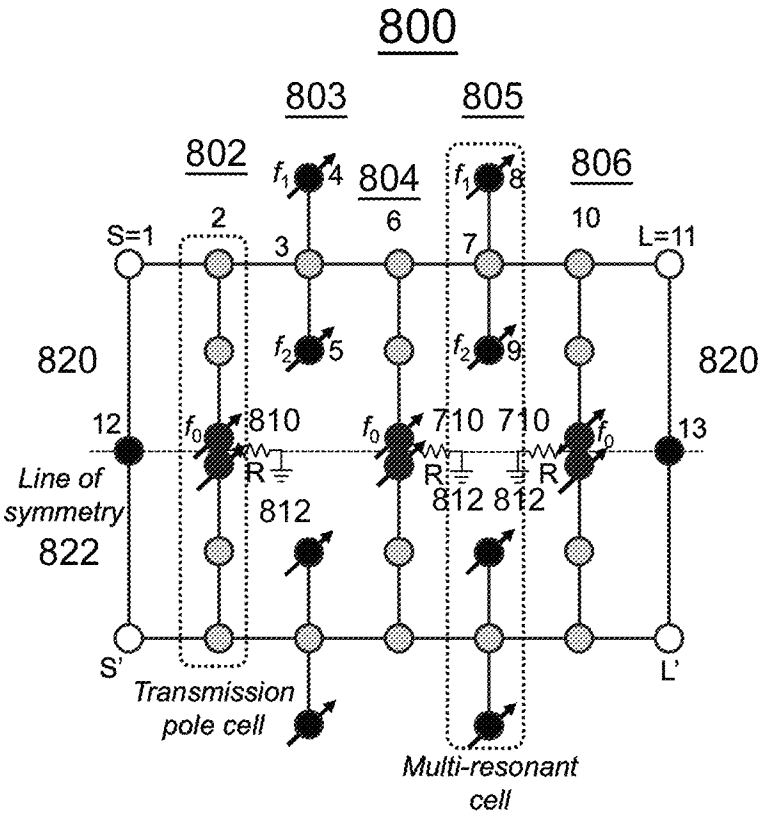
FIG. 8A is a coupling matrix diagram of a second high-order balanced/differential filter with enhanced out-of-band selectivity and higher common-mode suppression.

FIG. 8A is a CMD of another, higher order, balanced filter with higher selectivity in the differential mode of operation and higher common mode suppression. FIG. 8B is a diagram illustrating the conceptual differential mode and common-mode response of the design of FIG. 8A. The indicated traces and labels correspond to the following S-parameters. $|S_{dd11}|$ is the input reflection coefficient of the differential mode. $|S_{dd21}|$ is the power transmission coefficient of the differential mode. $|S_{cc11}|$ (not shown) is the input reflection coefficient of the common mode. $|S_{cc21}|$ is the power transmission coefficient of the common mode.

The embodiment of FIG. 8A is similar to that of FIG. 2A, with two additional resonant sections with the purpose of increasing selectivity in the differential mode and increasing suppression in the common mode. Resonant sections are 802-806. Sections 802, 804, and 806 are TPCs while sections 803 and 805 are MRCs. In addition, the embodiment of FIG. 8A includes lines 820 at the input and the output and resonant nodes 12, 13. The virtual open results in two open-ended impedance inverters at the balanced input/output ports which result in two TZs ($TZ_5$ & $TZ_6$) that are located at the center frequency of the filter and are responsible for canceling out $P_2$. As such, the open-ended impedance inverters in the common mode CMD equivalent are represented as resonating nodes (12 and 13) that are connected to the source/load through impedance inverters. Therefore, the common-mode is suppressed through added TZs as well as resistive-loading. Ground 812 is indicated.

The embodiment of FIG. 8A is the CMD of a high-order fully-reconfigurable balanced BPF. It exhibits quasi-elliptic-type high-order power transmission response in the differential mode of operation and a highly suppressed common mode. The differential mode is shaped by four transmission zeros (TZs) and five poles and the overall response is tunable in terms of center frequency and BW and can be intrinsically switched-off. Embodiments include a mixed integration scheme using capacitively-loaded ceramic coaxial and microstrip resonators for size compactness and low insertion loss (IL). See FIGS. 10C-D. The quarter-wave series-type resonances of the coaxial resonator are used for the suppression of spurious modes in the out-of-band response of the differential mode resulting in a wider out-of-band suppression BW when compared to the embodiment in FIG. 2A.

White circles are sources and loads. Grey circles are non-resonating nodes. Black circles are resonating nodes. Black lines are static couplings. As in FIG. 2A, the RF input (i.e., source) is at S, S' and the RF output (i.e., load) is at L, L'.

Figure 9A:
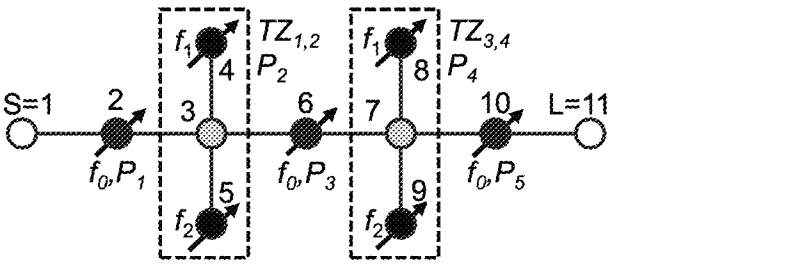
FIG. 9A is a diagram of the differential-mode portion equivalent of the filter of FIG. 8A.
Figure 9B:
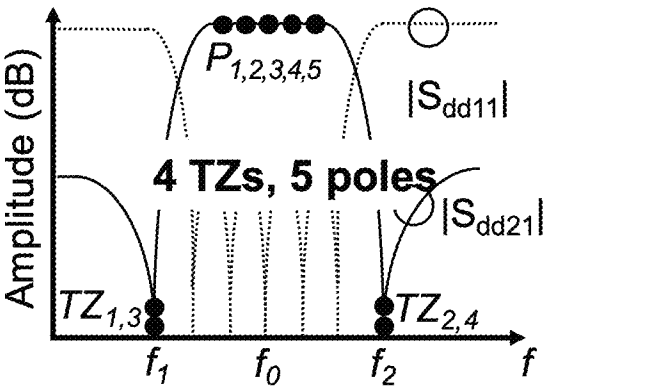
FIG. 9B is a plot illustrating the response of the differential-mode portion of the design of FIG. 8A.

FIG. 9A is an equivalent CMD of the differential mode portion equivalent of the differential/balanced filter 800. FIG. 9B is a plot illustrating the response of the differential-mode portion of the design of filter 800. Under the differential mode of operation, a virtual ground is present along the line of symmetry and the response of the filter can be represented by the equivalent single-ended CMD in 9A. In particular, the virtual ground cancels the resistors 810 which can be neglected in the differential mode of operation. Furthermore, the virtual ground shorts (at nodes 12 and 13) the impedance inverters at the balanced input and output ports, which act as all-pass networks and can be neglected in the CMD equivalent.

FIG. 9B shows the response of the differential-mode CMD of FIG. 9A in which each of the in-line resonating nodes (nodes 2, 6, and 10) introduce one frequency tunable pole ($P_1$, $P_3$, $P_5$) located at the center frequency of the passband.

Additionally, nodes 3-5 (and 7-9) interact with each other and result in two frequency variant TZs, $TZ_1$ & $TZ_2$ ($TZ_3$ & $TZ_4$), and one pole, $P_2$ ($P_4$). $TZ_1$ and $TZ_2$ are located at the resonant frequencies of nodes 4 and 5, and $P_2$ is located at the frequency at which the two input admittances looking towards nodes 4 and 5 from node 3 cancel out. The differential mode contains a total of four TZs and five poles.

Figure 9C:
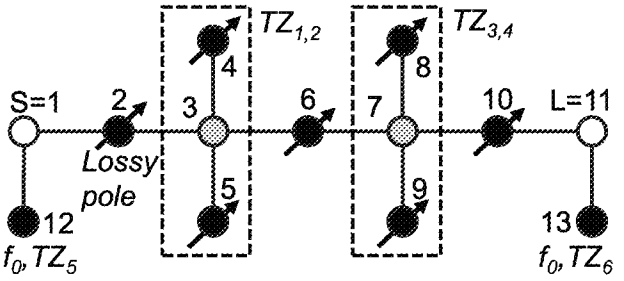
FIG. 9C is a diagram of the common-mode portion equivalent of the filter of FIG. 8A.
Figure 9D:
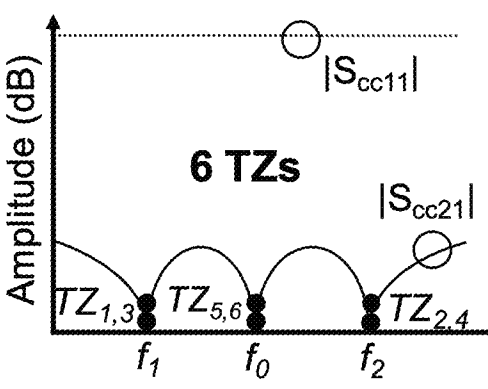
FIG. 9D is a plot illustrating the response of the common-mode portion of the design of FIG. 8A.

FIG. 9C is an equivalent CMD of the common-mode portion equivalent of the differential/balanced filter 800. FIG. 9D is a plot illustrating the response of the common-mode portion of the design of filter 800. The expanded set of nodes 2, 6, and 10 in FIG. 8A are each replaced by an equivalent lossy resonant node. Under common mode excitation, a virtual open appears along the line of symmetry 822 and the response of the filter can be represented by the single-ended CMD. The virtual open circuit permits the operation of the resistors—represented as lossy resonators (nodes 2, 6, and 10) in the common mode CMD equivalent. Resistors 810 resistively load the resonators and weaken the presence of the poles, $P_1$, $P_3$, and $P_5$, which would otherwise enable RF signal transmission. Furthermore, the virtual open results in two open-ended impedance inverters at the balanced input/output ports which result in two additional TZs, $TZ_5$ and $TZ_6$, that are unique to the common mode and enhance its suppression. These TZs are located at the center of the passband and cancel out the effect of the poles, $P_2$ and $P_4$.

The resonating nodes 12 and 13 and their connecting impedance inverters in FIG. 8A are implemented in this embodiment with half-wavelength long transmission lines (TLs). The overall common mode response consists of six TZs (two unique to the common mode) as shown in FIG. 9D.

FIG. 10A is an annotated diagram of the design of filter 700, for convenient correspondence with FIG. 10B. FIG. 10B is a diagram of the physical layout of circuitry implementing the design of filter 800. See blocks 1002, 1004, and 1006 implemented in FIG. 10B. FIG. 10C is a diagram of a coaxial resonator 1020 used in the circuitry of FIG. 10B. FIG. 10D is a plot showing the ideal response of the circuitry of FIG. 10B.

Figure 11A:
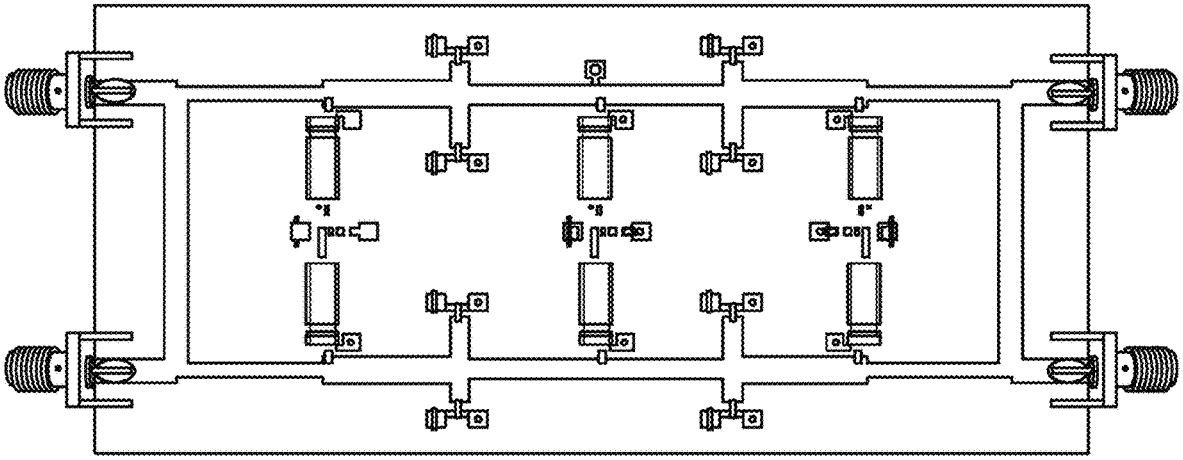
FIG. 11A is an image of a manufactured filter based on the design shown in FIG. 10A and the circuitry layout in FIG. 10B.

FIG. 11A is an image of a manufactured filter 800 based on the design shown in FIG. 8A and the circuitry layout in FIG. 10B. To validate the fully-reconfigurable balanced BPF concept, a mixed-technology prototype was designed at 2.7 GHz with a fractional BW of 10%. A photograph of the prototype is shown in FIG. 11A. It was designed on a Rogers RO4003C substrate with relative dielectric permittivity $\varepsilon_r$=3.38, dielectric thickness H=1.52 mm, and dielectric loss tangent $\tan(\delta_D)$=0.0027. Resonating nodes 4, 5, 8, and 9 were incorporated with their connecting impedance inverters. They were equivalently realized with open-ended capacitively-loaded quarter-wavelength resonators. Furthermore, resonating nodes 2, 6, and 10 were realized with ceramic coaxial resonators. To enable the multiple levels of tunability varactors were added at the end of each resonator.

Filter 800 results in a highly selective transfer function and suppresses the common mode by 70 dB at the center frequency and by greater than 50 dB in the range 2.14-2.94 GHz. It achieves center frequency tuning in the range 2.22-2.94 GHz (1.32:1 ratio) while maintaining a common mode suppression of at least 35 dB within a wide frequency range. The BW can be tuned from 104 MHz (4%) to 268 MHz (10.1%) tuning ratio of 2.58:1, and maintains a common mode suppression of over 50 dB. In all of the aforementioned tuning states, the measured minimum in-band IL of the differential mode varies between 2.9-6.8 dB. In the intrinsic switching-off state, the differential mode transmission is suppressed by over 50 dB at the center frequency and by over 20 dB from 1.14 GHz to 3.16 GHz.

Figure 11B:
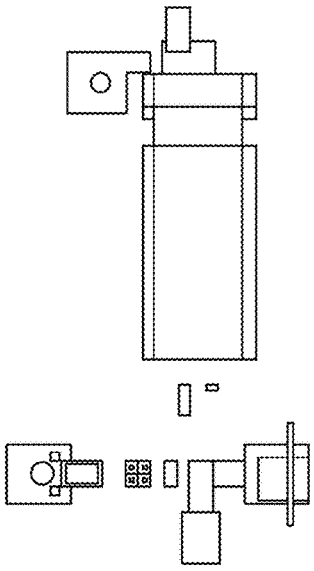
FIG. 11B is an image of the coaxial resonator of FIG. 10C.

FIG. 11B is an image of a hybrid coaxial resonator 1020 used in the circuitry of FIG. 10B-C.

To improve the out-of-band response of the differential mode while achieving low in-band IL, a new hybrid integration scheme using capacitively-loaded ceramic coaxial-resonators in nodes 2, 6, and 10 and quarter-wavelength long TL-based resonators in nodes 4, 5, 8, and 9 is used. The proposed resonator is shown in FIG. 10C and is based on commercially-available open-ended half-wavelength-long (at $f_{cen}$) tab-based coaxial ceramic resonators. In addition to the high-Q (>400) and size-compactness advantages of the ceramic-based resonator, its response can be exploited for cancelling the spurious bands in the differential mode. This is achieved by setting the TZs of the series-type quarter-wave resonances (first and second) of the coaxial ceramic resonator to the same frequencies as the spurious passbands. In practice, this is materialized by capacitively-loading the input of the ceramic resonator with a capacitor $C_{load}$ which tailors the location of the TZs. The TZs can be either arranged symmetrically or asymmetrically around the passband resonance that corresponds to the first half-wave resonance of the coaxial resonator.

Figure 12A:
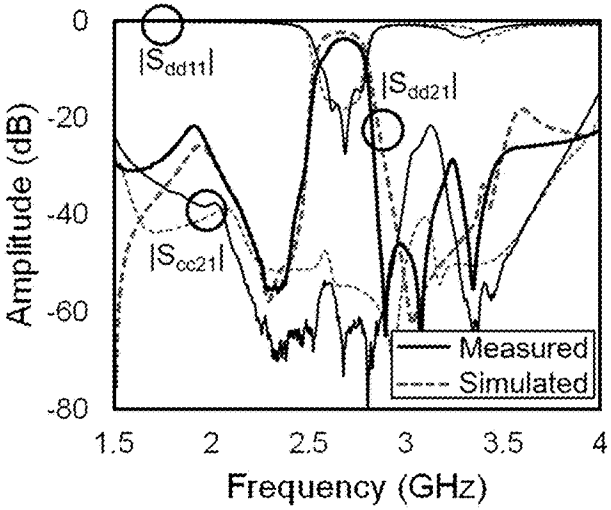
FIGS. 12A-12D are plots illustrating the performance of the embodiments of FIGS. 8A-11B.
Figure 12B:
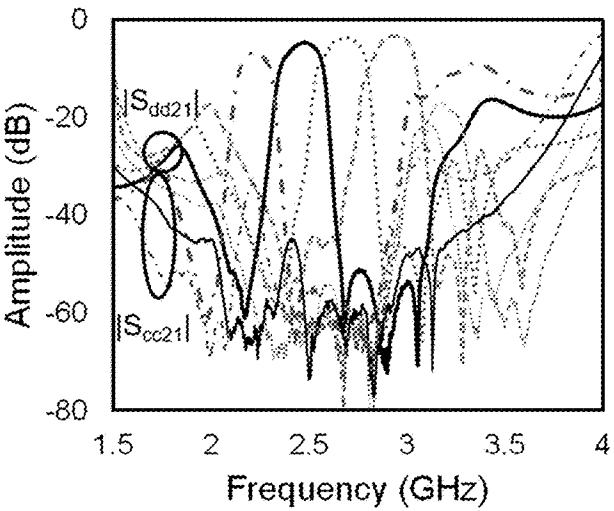
Figure 12C:
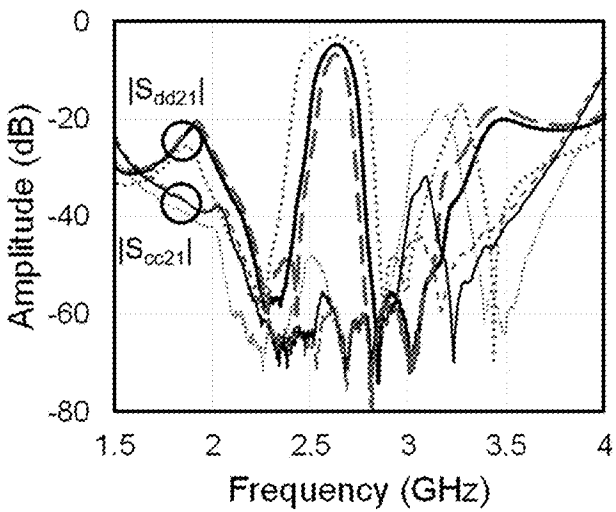
Figure 12D:
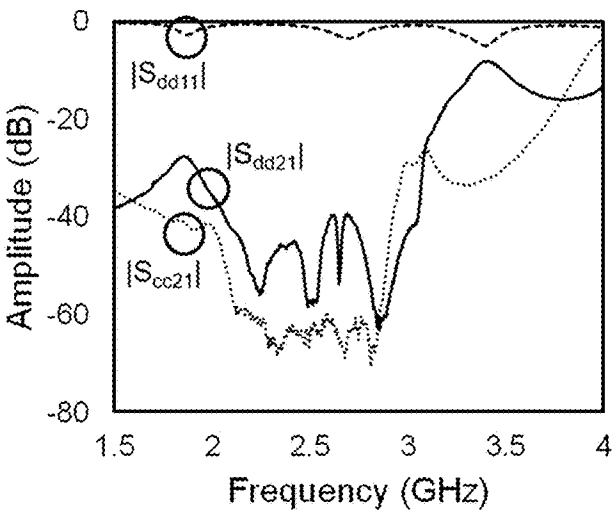

FIGS. 12A-12D are plots illustrating the performance of the embodiments of FIGS. 8A-11B. FIG. 12A is a plot comparing simulated and measured response of the circuitry of FIG. 11A. FIG. 12B is a plot showing measured center frequency tuning of the circuitry of FIG. 11A. FIG. 12C is a plot showing measured BW tuning of the circuitry of FIG. 11A. FIG. 12D is a plot showing measured switching off of the circuitry of FIG. 11A.

Figures 13A, 13B, 13C:
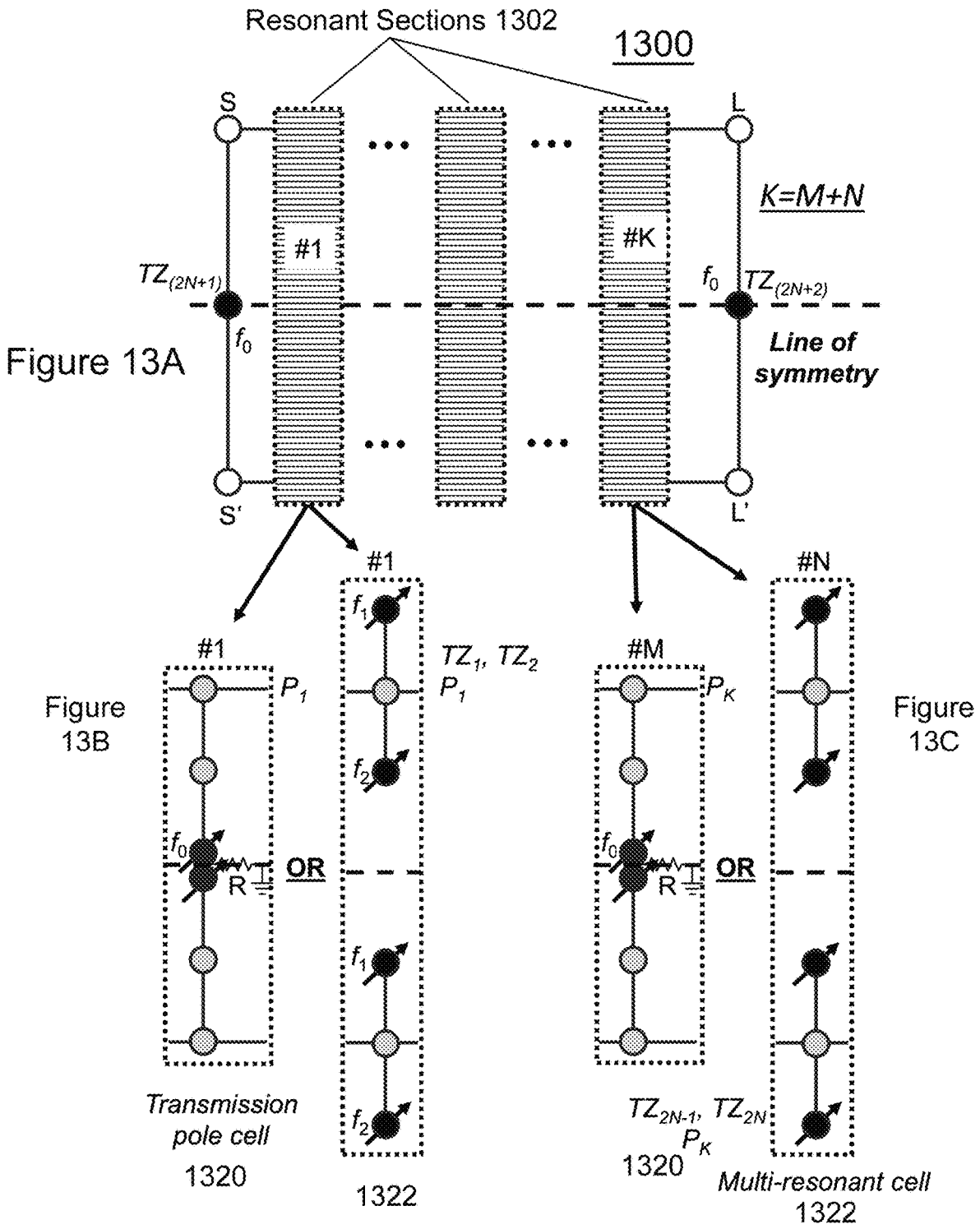
FIG. 13A is a diagram illustrating the expansion of the differential/balanced bandpass filter concept to arbitrary order transfer functions in the differential and in the common modes of operation that is achieved by adding resonant sections.
FIG. 13B is a diagram of the first resonant section that can either be a TPC or a MRC.
FIG. 13C is a diagram of the final resonant section. Many more of these resonant sections can be cascaded within the coupling matrix diagram in FIG. 13A.
Figure 13D:
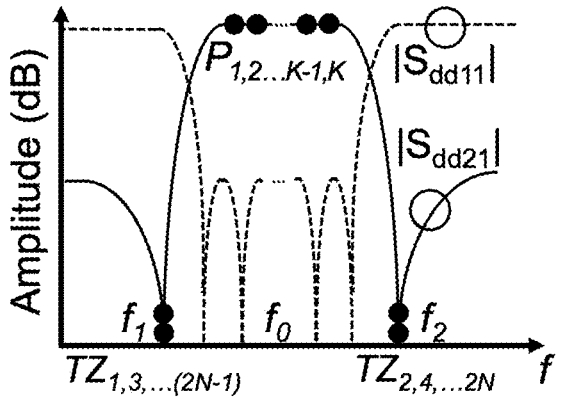
FIGS. 13D-J illustrate various examples of embodiments based on the FIG. 13A configuration.
Figure 13E:
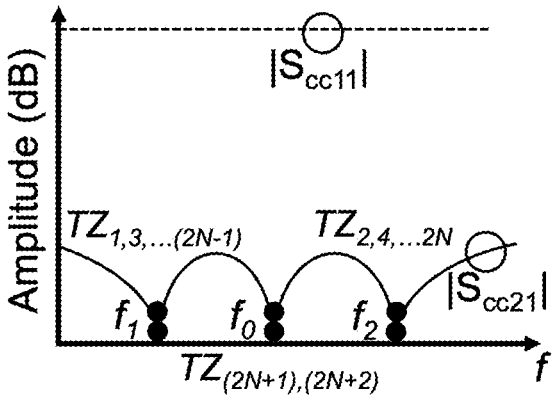

FIG. 13A is a generalized CMD illustrating the expansion of the differential/balanced bandpass filter concept to an arbitrary order with increased selectivity in the differential mode and high suppression in the common mode. This is achieved by adding resonant sections 1302 (theoretically infinite). FIG. 13B is a diagram of the first resonant section, comprising either a TPC 1320 or an MRC 1322. FIG. 11C is a diagram of the last resonant section, also comprising either a TPC 1320 or a MRC 1322.

In FIGS. 13A-C, gray circles are non-resonant nodes and black circles are resonant nodes. Black lines are impedance inverters. Dashed rectangles denote resonant sections 1302 that can comprise either a transmission pole cell 1320 or a multi-resonant cell 1322.

The fully-reconfigurable, quasi-elliptic balanced bandpass filter concept of FIG. 13A can be expanded to high order transfer functions with theoretically arbitrary number of poles (1 to K=M+N) and TZs (1 to 2N) in the differential mode of operation and arbitrary number of TZs in the common mode (2 to 2N+2) of operation. This is achieved by cascading multiple resonant sections between the differential RF input (SS') and the differential RF output (LL') and two TZ resonators in between the RF input and RF output as shown in FIG. 13A.

Each resonant section can be either made by a TPC 1320 or a MRC 1322 through impedance inverters. Each of the TPCs 1320 comprises two resistively-terminated resonators (black circles) that resonate at the center frequency of the filter $f_0$ and four non-resonating nodes (grey circles) and creates a pole at $f_0$.

Each of the MRCs 1322 comprises four resonators (black circles) and two non-resonating nodes (grey circles) and creates one pole at $f_0$ and two transmission zeros at the resonant frequencies of the resonating nodes (e.g., at $f_1$, $f_2$ for the MRC 1322).

The filter design is modular such that the TPCs 1320 and MRCs 1322 can be cascaded arbitrarily (i.e., without order or pattern). Thus, a generalized differential/balanced filter architecture with K (K=M+N) resonant sections 1302 made from M TPCs 1320 and N MRCs 1322 will exhibit: i) K poles and 2N TZs in the differential mode of operation and ii) K poles and 2N+2 TZs in the common mode of operation that can be arranged in an arbitrary fashion and create alternative types of transfer functions.

Illustrative examples for both the differential and the common mode of operation are shown in FIGS. 13D-J. In particular, FIGS. 13D (differential mode) and 13E (common mode) show how a quasi-elliptic bandpass response can be obtained in the differential mode with K poles in the passband and 2N TZs in the stopband where all the TZs are arranged at two distinct frequencies $f_1$ and $f_2$. For this filter topology the common mode of operation will be shaped by three distinct TZs (two at $f_0$, N at $f_1$ and N at $f_2$).

Figure 13F:
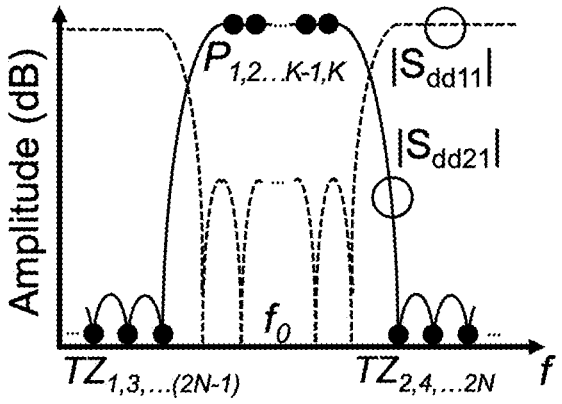
Figure 13G:
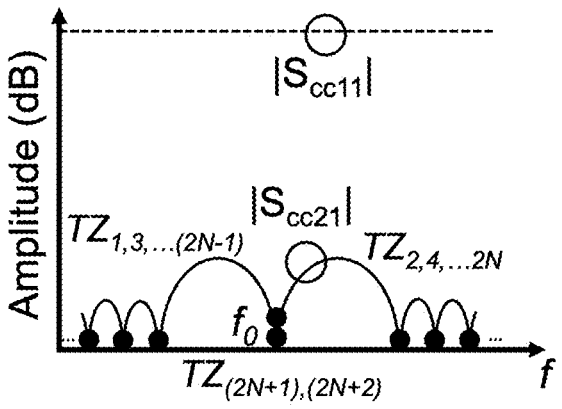
Figure 13H:
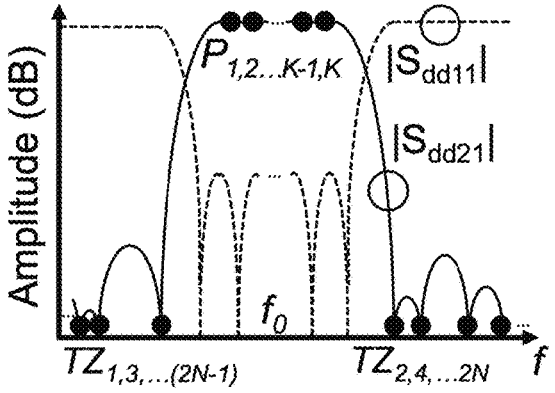
Figure 13I:
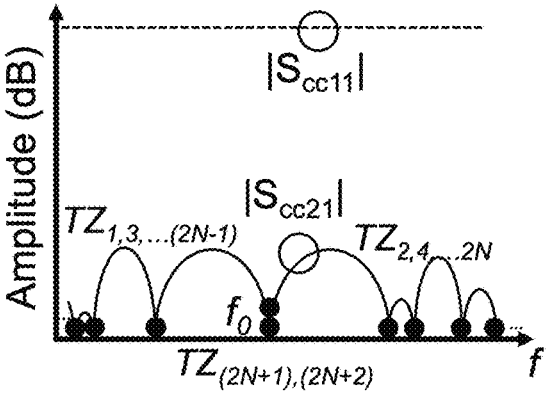

In another configuration illustrated in FIGS. 13F (differential mode) and 13G (common mode), the multi-resonant cells can be set to resonate at different frequencies leading to quasi-elliptic transfer functions with wide out-of-band suppression enabled by the TZs of the multi-resonant cells 1302 being spread symmetrically in the stopband areas. The embodiment of FIGS. 13H (differential mode) and 13I (common mode) is similar, but the TZs are spread asymmetrically in the stopband areas.

Figure 13J:
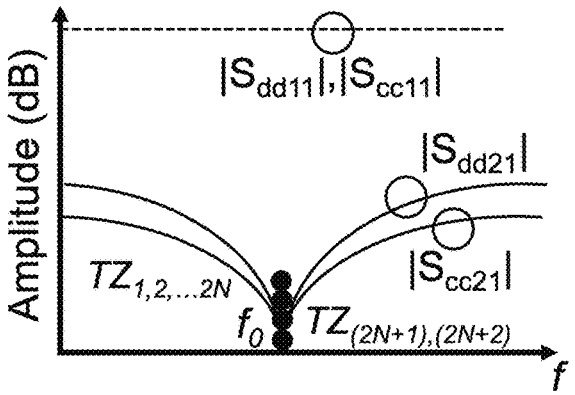

Lastly the multi-resonant cells 1322 can be designed so that their TZs are aligned at one frequency $f_0$ leading to an intrinsically-switched off response in both modes as shown in FIG. 13J.

Tunability between the illustrated transfer functions in terms of center frequency, bandwidth and intrinsic-switching can be achieved by tuning the resonant frequency of the resonators.

While the exemplary preferred embodiments of the present invention are described herein with particularity, those skilled in the art will appreciate various changes, additions, and applications other than those specifically mentioned, which are within the spirit of this invention.

What is claimed is:

1. A balanced/differential bandpass filter comprising:

multiple resonant sections cascaded between a differential RF input and a differential RF output;

wherein the resonant sections comprise at least one multi-resonant cell (MRC) and at least one transmission pole cell (TPC); and wherein each MRC includes four frequency tunable MRC resonators, and is configured to create a frequency tunable pole at a center frequency of the filter ($f_0$), and two frequency tunable transmission zeroes (TZs) at resonating frequencies of MRC resonators;

wherein each TPC includes two resistively-terminated frequency-tunable TPC resonators configured to resonate at $f_0$; and wherein the balanced/differential bandpass filter is configured on a line of symmetry and each resonant section is symmetrically disposed along the line of symmetry.

2. The filter of claim 1 wherein the resonant sections are cascaded through impedance inverters.

3. The filter of claim 1 further configured to tune $f_0$ by synchronously tuning the resonance of the MRC resonators and the TPC resonators.

4. The filter of claim 1 further configured to tune a bandwidth of the filter by tuning the resonance of the MRC resonators.

5. The filter of claim 1 further configured to switch off by positioning the TZs of the MRC at the same frequency as the poles.

6. The filter of claim 1 wherein the resonant sections include two TPCs and one MRC—since it is each respective one of the multiple resonant sections that contain the TPCs and MRC.

7. The filter of claim 1 wherein the resonant sections include three TPCs and two MRCs—since it is each respective one of the multiple resonant sections that contain the TPCs and MRCs.

8. The filter of claim 1, further comprising a common-mode suppression line and TZ resonator disposed between ends of the differential RF input and a common-mode suppression line and TZ resonator disposed between ends of the differential RF input.

9. The filter of claim 1, comprising K resonant sections, M TPCs and N MRCs, configured to result in between 1 and N TZs in the differential mode of operation and between 2 and 2N+2 TZs in the common mode of operation.

10. The filter of claim 1 implemented with hybrid integration by including both capacitively loaded coaxial resonators and microstrip resonators.

11. The filter of claim 10 wherein the TCP resonators comprise capacitively loaded coaxial resonators and the MRC resonators comprise quarter wavelength long transmission line resonators.

12. The filter of claim 1 configured to suppress the common mode by at least 70 dB at a selected center frequency and by at least 50 dB in a 1.5:1 bandwidth.

13. The filter of claim 1 configured to switch off the filter by at least 40 dB at a selected center frequency and by at least 20 dB in a 2:1 bandwidth.

14. The filter of claim 1 configured to tune the center frequency by at least a 1.3:1 bandwidth.

15. The filter of claim 1 configured to tune the bandwidth by at least 2.5:1.

16. The filter of claim 1 configured to tune $f_0$ by synchronously tuning the resonance of the MRC resonators and the TPC resonators to tune a bandwidth of the filter by tuning the resonance of the MRC resonators; and to switch off by positioning the TZs of the MRC at the same frequency as the poles.

17. The method of tuning balanced/differential bandpass filter comprising the steps of:

providing at least one multi-resonant cell (MRC) and at least one transmission pole cell (TPC) cascaded between a differential RF input and a differential RF output; and wherein each MRC includes four frequency tunable MRC resonators, and is configured to create a frequency tunable pole at a center frequency of the filter ($f_0$), and two frequency tunable transmission zeroes (TZs) at resonating frequencies of MRC resonators;

wherein each TPC includes two resistively-terminated frequency-tunable TPC resonators configured to resonate at $f_0$;

configuring the balanced/differential bandpass filter along a line of symmetry with each resonant section symmetrically disposed along the line of symmetry; and tuning the center frequency $f_0$ by synchronously tuning the resonance of the MRC resonators and the TPC resonators.

18. The method of claim 17 further including the step of tuning a bandwidth of the filter by tuning the resonance of the MRC resonators.

19. The method of claim 18 further including the step of switching off the filter by positioning the TZs of the MRC at the same frequency as the poles.

20. The method of claim 19 wherein the step of tuning the center frequency, the step of tuning the bandwidth, and the step of switching off the filter are all accomplished without requiring tuning couplings.

* * * * *